United States Patent [19]

Murakami et al.

[11] 4,138,279

[45] Feb. 6, 1979

[54] METHOD OF PRODUCING STAINLESS STEEL PRODUCT

[75] Inventors: Shinichi Murakami, Osaka; Katsutaro Akamatsu, Hirakata; Arata Yoshimitsu, Katano; Sueyoshi Noji, Hirakata, all of Japan

[73] Assignee: Kubota, Ltd., Osaka, Japan

[21] Appl. No.: 773,120

[22] Filed: Feb. 28, 1977

[30] Foreign Application Priority Data

Mar. 1, 1976 [JP] Japan ..... 51-22913
Mar. 1, 1976 [JP] Japan ..... 51-22914

[51] Int. Cl.[2] ..... C21D 7/02
[52] U.S. Cl. ..... 148/12 E
[58] Field of Search ..... 148/12 E, 38

[56] References Cited

U.S. PATENT DOCUMENTS 3,689,325 9/1972 Hayden, Jr. et al. ..... 148/12 E
3,826,689 7/1974 Ohta et al. ..... 148/12 E
3,844,846 10/1974 Friske et al. ..... 148/12 E
4,002,510 1/1977 Wilde ..... 148/38

*Primary Examiner*—W. Stallard
*Attorney, Agent, or Firm*—Wenderoth, Lind & Ponack

[57] ABSTRACT

A method of producing stainless steel products superior in intergranular corrosion resistance and applicable to ultrasonic flaw detection, in which austenite group stainless cast steel containing 5 to 40% of ferrite phase is employed as base material, part or all of which base material is subjected to plastic deformation or plastic processing such as pulling, pressing, bending, tension processing and the like, with subsequent recrystallizing heat treatment for the improvement of intergranular corrosion resistance by making its cast structure fine and reducing surface roughening developed due to deformation during the plastic processing, and for making it possible to successfully apply ultrasonic flaw detection to such cast steel products.

2 Claims, 13 Drawing Figures

METHOD OF PRODUCING STAINLESS STEEL PRODUCT

Figure 1:
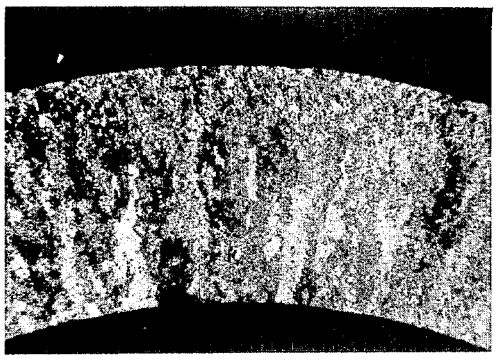

The present invention relates to a stainless steel product and more particularly, to a method of manufacturing a stainless steel product having superior intergranular corrosion resistance and capability of being subjected to ultrasonic flaw detection.

As is well known in the art, for important parts, for example, of atomic power plant equipment, various apparatuses related to petrochemical industries or the like, non-destructive tests such as radiographic inspection and ultrasonic flaw detection are required in many cases for strict quality control of these parts. Although stainless cast steel products of austenite group are largely employed for such parts, for example, pipes, elbows, etc., in petroleum purification owing the their superior corrosion resistance, these stainless cast steel products are generally coarse in cast structure and consequently unsuited to ultrasonic flaw detection, thus requiring the radiographic inspection to be employed for flaw detection. The radiographic inspection, however, has such a disadvantage that false defect patterns tend to be detected when the thickness of the object to be tested is less than approximately 30 mm, with consequent inaccuracy in test results. Accordingly, in order to make it possible to apply the ultrasonic flaw detection to the stainless cast steel products, there have conventionally been employed various methods such as addition of elements, for example, Al, Ti, B or the like to the cast steel products or quenching of such cast steel products by a chiller for making their cast structure fine. However, even with these methods, applicability of the cast steel products to the ultrasonic flaw detection has not been improved satisfactorily.

Furthermore, if the stainless cast steel products of austenite group of the above described type are subjected to plastic processing or plastic deformation such as pulling, bending, pressing or tension processing as they are, there has been encountered such a phenomenon that undulation or roughening (concave and convex portions) amounting to several millimeters in height is formed on the deformed surface of the cast steel products. This phenomenon results in such a disadvantage that when elbows, bends and the like are to be produced, for example, by bending straight pipes of stainless cast steel, the undulation kind above described kind is undesirably formed on inner and outer surfaces of the bent portions of such pipes, and the elbows or bends thus produced can not be used as finished products as they are, due to their roughened surfaces, requiring further processing such as cutting or grinding. Such further processing will bring about various problems not only from an economical point of view, but from technical aspects, for example, removal of the undulation of the inner surfaces of the elbows or bends.

On the other hand, concerning press forged products of single phase austenite stainless steel which have also been widely employed conventionally, they have drawbacks in intergranular corrosion resistance, while having favorable applicability to the ultrasonic flaw detection due to their fine crystal grains through press forging, without any problems of the roughened surface as in the cast steel products, even in the plastic processing. In order to overcome the problems related to the intergranular corrosion resistance, there have conventionally been taken various countermeasures, for example, reduction of carbon content to an extremely low level as C $\leqq$ 0.03% in comparison with the commonly accepted level of 0.08% and under, or addition of stabilizing elements such as Ti and Nb to the press forged stainless steel products, which countermeasures, however, still have various problems to be solved in the aspects of performance and resultant cost of such stainless steel products. For the improvement of the intergranular corrosion resistance, it has been found by the present inventors that inclusion of ferrite phase in the austenite is very effective as mentioned more in detail later, and if austenite group pressure forged stainless steel product including ferrite is readily obtained, various problems inherent in the conventional stainless steel products such as the poor applicability to the ultrasonic flaw detection, intergranular corrosion resistance and roughening of the surfaces during the plastic deformation may be simultaneously solved. However, since the austenite group stainless steel containing ferrite has properties unsuitable for the press forging, it is not easy to apply the conventional manufacturing method thereto wherein intensive plastic deformation is applied to ingots to produce the press forged stainless steel products, and thus production of such press forged stainless steel products is extremely difficult both technically and from an economical point of view.

Accordingly, an essential object of the present invention is to provide an improved method of manufacturing stainless steel products which are superior in intergranular corrosion resistance and are capable of being subjected to ultrasonic flaw detection, with substantial elimination of disadvantages inherent in the conventional stainless steel products.

Another important object of the present invention is to provide an improved method of manufacturing stainless steel products as described above which are free from surface roughening during plastic processing or plastic deformation.

A further object of the present invention is to provide an improved method of manufacturing stainless steel products as described above by which the stainless steel products of high performance can be readily produced at low cost.

In accomplishing these objects, in one preferred embodiment of the present invention, austenite group stainless cast steel product containing 5 to 40% of ferrite phase is employed as a base material, part or all of which base material is subjected to plastic deformation to the degree of at least 10%, for example, by pressing, bending, tension processing and the like, with subsequent recrystallizing heat treatment thereof for the improvement of intergranular corrosion resistance by making its cast structure fine, and for reduction of the surface roughening developed due to deformation during the plastic processing, and also for making it possible to successfully apply the ultrasonic flaw detection to such cast steel products.

Figure 2:
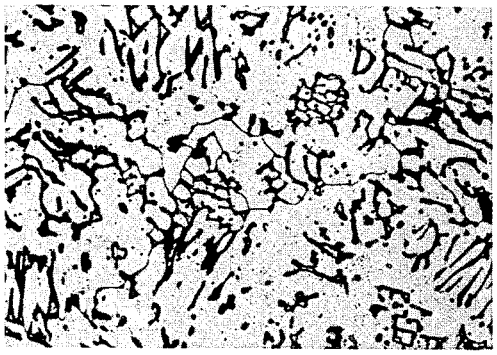
Figure 3:
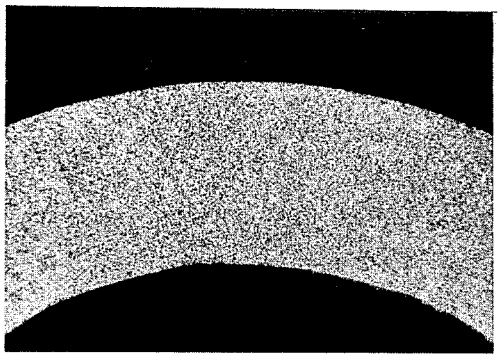
Figure 4:
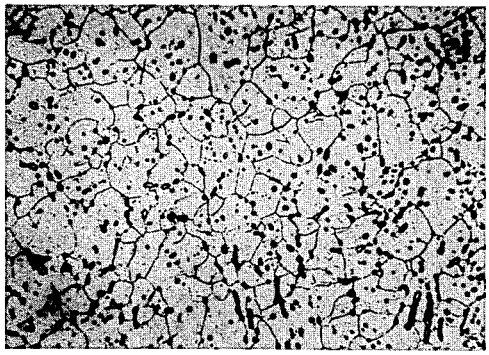
Figure 5:
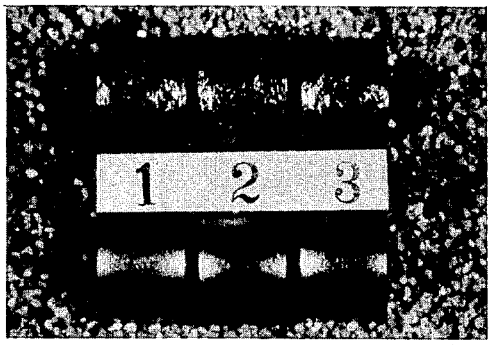
Figure 7:
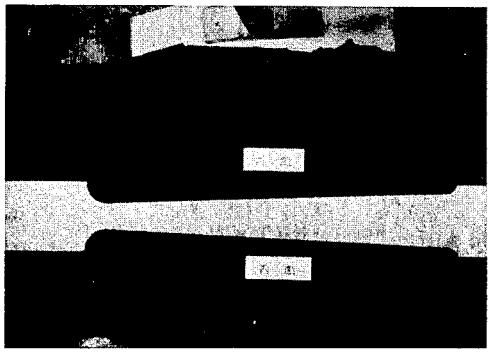
Figure 6:
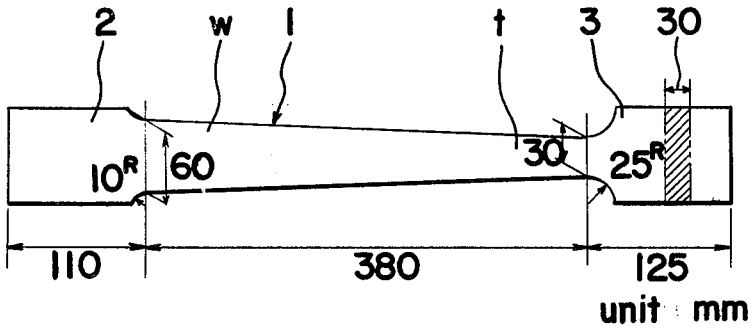
Figure 9:
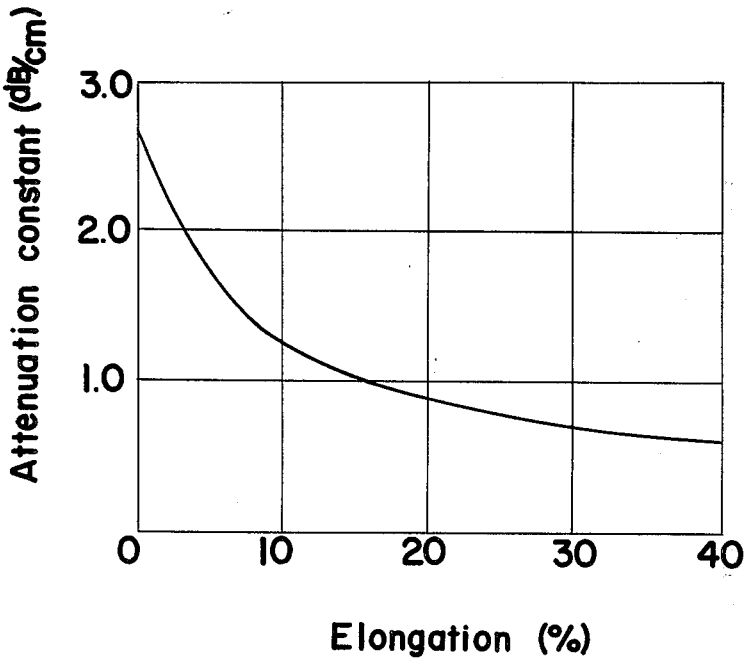
Figure 8:
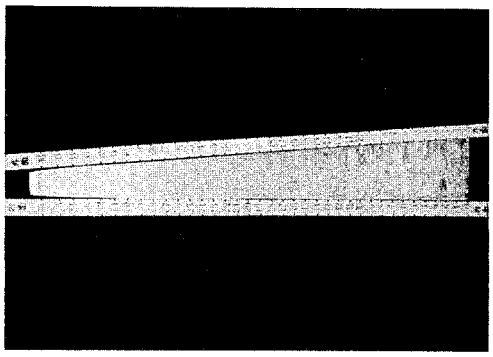
Figure 10:
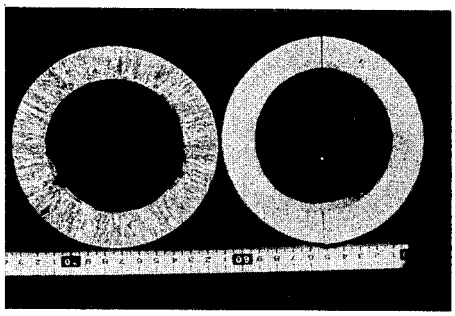
Figure 11:
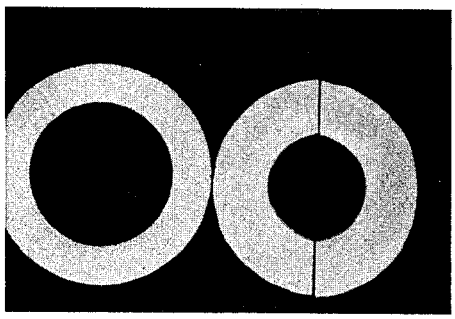

These and other objects and features of the present invention will become apparent from the following description taken in conjunction with the preferred embodiment thereof with reference to the attached photographs and drawings, in which;

FIG. 1 is a photograph showing, in cross section, a macro cast structure of a base material cast pipe according to EXAMPLE 1 of the present invention, FIG. 2 is a photograph similar to FIG. 1, but particularly shows a micro cast structure thereof, FIG. 3 is a photograph similar to FIG. 1, but particularly shows its macro cast structure after cold drawing and recrystallizing treatment, FIG. 4 is a photograph similar to FIG. 3, but particularly shows its micro cast structure, FIG. 5 is a photograph showing external appearances of the base material cast pipe and the recrystallized cast pipe after subjecting these to intergranular corrosion resistance test according to one method of the present invention, FIG. 6 is a top plan view of a test piece prepared for assessment of variations of the macro cast structure and applicability to ultrasonic flaw detection with respect to degree of plastic processing according to EXAMPLE 2 of the present invention, FIG. 7 is a photograph showing a macro cast structure of the test piece of FIG. 6 in a state as it is cast, FIG. 8 is a photograph similar to FIG. 7, but particularly shows the macro cast structure of the above test piece after subjecting it to pulling and heat treatment, FIG. 9 is a graph showing the relation between elongation of the test piece of FIG. 7 and attenuation constant of ultrasonic waves according to EXAMPLE 2 of the present invention, FIGS. 10(*a*) and 10(*b*) are photographs respectively showing, in cross sections, a macro cast structure of a centrifugal cast pipe in the state as it is cast, and a macro cast structure of the same centrifugal cast pipe after having been subjected to plastic deformation and recrystallizing treatment according to EMBODIMENT 1 of the present invention, and FIGS. 11(*a*) and 11(*b*) are photographs respectively showing, in cross sections, a macro cast structure of a centrifugal cast pipe in the state as it is cast, and a macro cast structure of the same centrifugal cast pipe after having been subjected to compression plastic deformation and recrystallizing treatment.

According to one preferred embodiment of the present invention, austenite-ferrite two phase stainless steel having ferrite included in austenite, and superior in intergranular corrosion resistance is employed as raw material, from which a cast steel base material having a configuration, before plastic deformation or processing, not of an ingot commonly employed as press forging base material, but close to that of the intended final product, is prepared, and is subsequently subjected to plastic deformation of a comparatively small degree of processing, and then to recrystallizing heat treatment to convert its coarse cast structure into a fine structure for improving intergranular corrosion resistance, and for solving the problems related to surface roughening during the plastic deformation and to applicability thereof to the ultrasonic flaw detection.

As is earlier mentioned, various countermeasures conventionally taken for the improvement of the intergranular corrosion resistance of the austenite group stainless steel, such as reduction of its carbon content to an extremely low level of 0.03% and under or addition of the stabilizing elements, for example, Ti and Nb, have not shown fully satisfactory results, still leaving numerous problems to be solved. According to the method of the present invention, the above problem of improving the intergranular corrosion resistance has advantageously been solved in a manner quite different from the known methods, i.e., by inclusion of the ferrite phase in austenite.

It is known that inclusion of ferrite in austenite improves the strength of stainless steel material and also resistance thereof against stress corrosion, but simultaneous improvement of the intergranular corrosion resistance therefrom has first been found through experiments by the present inventors. The inclusion of ferrite phase as described above is not only advantageous for the improvement of the intergranular corrosion resistance, but also remarkably effective for making the cast structure fine as is described in detail later, thus constituting one of the essential features of the present invention.

In the method according to the present invention, mixing rate of the ferrite phase is determined to be 5 to 40%, since if the rate is under 5%, effect of improving the intergranular corrosion resistance as described above is not sufficient, while if the rate is over 40%, normal corrosion resistance of the stainless steel itself tends to be reduced, giving rise to various problems due to continuity of the ferrite phase.

Additionally, it is well known in the art that the adjustment of the amount of ferrite phase as described above is readily achieved by adjusting the balance of alloy components such as Cr and Ni, and making the amount of carbon in such alloy equal to that in ordinary austenite stainless steel, i.e., 0.08% and under may sufficiently serve the purpose.

While the material to be employed in the method of the present invention is explained in the foregoing description, making the cast structure fine will be described hereinbelow.

Stainless steel products which are generally used in the configurations as they are, even if they may be subjected to machining, have a coarse cast structure. Although various methods have conventionally been effected to make their cast structure fine, for example, through improvements of their chemical compositions, improvements in molds, casting methods and the like, it is still difficult to make them equal in quality to press forged products.

In the present invention, however, since the austenite group stainless steel including ferrite is employed as base material, fine cast structure equal to that of the press forged product can advantageously be obtained through plastic processing of comparatively small degree and recrystallizing heat treatment.

As is seen from the above description, the stainless cast steel involved in the present invention has ferrite included in austenite, and its cast structure itself is more likely to be readily made fine than that of austenite single phase stainless cast steel. Furthermore, the cast steel products of such cast steel are not of such heavy weight and large thickness as in the ingots which are the base materials of the press forged materials, from which point also, the cast structure is finer than that of general press forging materials (ingots). Moreover, the presence of ferrite phase has such an effect as to expedite the processing of austenite phase during the plastic processing, thus making it possible to make the crystal grains fine by the recrystallizing heat treatment even through a comparatively small degree of plastic processing. In the present invention, the degree of plastic processing (surface reduction rate, compression rate, elongation rate, etc.) is determined to be 10% and over from the viewpoint of improving applicability to the ultrasonic flaw detection, although the recrystallization is possible even if the degree of plastic processing is under this level, and the fine or micro-structure of the crystal grains achieved by the plastic processing degree of 10% and over simultaneously solves the problem of surface roughening encountered during the plastic deformation.

In the method of the present invention, although an upper limit of the plastic processing degree is not particularly defined, it is generally advantageous to utilize the configuration and property of the cast product itself. Therefore, it is not required to effect the plastic processing to an extent of 50% and over unless such plastic processing is particularly necessary.

It should be noted here that the plastic processing as described above is not limited in its method, and various processings such as drawing, compression, pulling, rolling, hydraulic molding, forging and the like may be applicable thereto, and that such plastic processing may be a partial processing effected on a particular portion of the cast steel base material for which fine crystal grains are desired.

It should also be noted that in the plastic processing as described above, deformation in the degree of 10% and over may be effected at one time (provided that base materials are not subjected to such defects as cracking, etc.), or several times of gradual deformation may be effected to finally amount to 10% and over.

After the plastic processing or deformation as described above, the cast steel product is subjected to the recrystallizing heat treatment.

If it is necessary to eliminate work-hardening in the course of the above plastic processing, an intermediate heat treatment for softening may be effected. Such an intermediate heat treatment can also serve the purpose of recrystallizing heat treatment, and both of the intermediate heat treatment and recrystallizing heat treatment should preferably be effected by heating the steel product up to approximately 1,000° to 1,200° C., with subsequent quenching. These heat treatments may also serve the purpose of solution heat treatment.

Additionally, since the recrystallization is effected considerably at high temperatures as described above, the plastic processing prior to said recrystallization need not necessarily be effected at normal temperatures, but can successfully be carried out at high temperatures so far as the effect of the recrystallizing heat treatment is not lost thereby. Meanwhile, if plastic processing of a large degree is to be effected, it is possible to carry out part of the processing at normal temperatures for the so-called recrystallization amounting to 10% and over as described earlier so as to complete the recrystallizing treatment at this stage, with the remaining processing being effected at high temperatures for shaping.

The following EXAMPLES are for the purpose of illustrating the present invention, without any intention of limiting the scope thereof.

EXAMPLE 1

A centrifugal cast pipe having external diameter 126$^{\phi}$, internal diameter 92$^{\phi}$ and length 3,500l (mm) (whose chemical compositions and amount of ferrite are given in TABLE 1 below) was machined at its external surface and end surfaces to obtain a test pipe of external diameter 119$^{\phi}$, internal diameter 92$^{\phi}$ and length 3,000l (mm). One end portion of the test pipe was crushed to form a grip portion thereat, and then the test pipe was heated up to 1,100° C., with subsequent quenching thereof. Thereafter, the test pipe was subjected to cold drawing and two heat treatments repeatedly through heating up to 1,100° C. and subsequent quenching, thus obtaining a pipe having external diameter 93.1$^{\phi}$ and internal diameter 64.5$^{\phi}$.

TABLE 1

| Chemical compositions and amount of ferrite (%) | | | | | |
|---|---|---|---|---|---|
| C | Si | Mn | Cr | Ni | Ferrite amount |
| 0.07 | 1.31 | 0.78 | 20.91 | 9.43 | 15 |

(Remainder is substantially Fe)

Referring to photographs of FIGS. 1 to 4, the photograph of FIG. 1 shows the macro cast structure of the above described cast pipe (base material of cast pipe), that of FIG. 2 the micro cast structure of the same cast pipe, while the photograph of FIG. 3 shows the macro cast structure of the same cast pipe subjected to the cold drawing and recrystallizing heat treatment, and that of FIG. 4 the micro cast structure of the cast pipe of FIG. 3.

As is seen from these photographs, in the macro cast structure, the recrystallized material has very fine cast structure equal to that of the press forged material in general, as compared with the coarse cast structure in the cast pipe base material, while in the micro cast structure, the recrystallized material has fine austenite crystal grains as compared with scarce grain boundary and coarse crystal grains in the cast pipe base material.

The results of the ultrasonic flaw detection carried out on the recrystallized pipes as described above were fully satisfactory, showing performance equal to that of the comparative test piece SUS304.

Referring to the photograph of FIG. 5 showing appearance of each of the test specimens after the intergranular corrosion tests carried out on the above mentioned cast pipe base material and recrystallized pipes, it is cleary seen that the cast pipe base materials at the upper line of the photograph (above identification numerals 1, 2 and 3) of FIG. 5 have increased surface undulation or roughness due to bending, while the recrystallized materials at the lower line of the same photograph have smooth surfaces, although both the cast pipe base materials and the recrystallized pipes were free from the problem of intergranular corrosion.

EXAMPLE 2

A test piece 1 having demensions as shown in FIG. 6 was prepared for assessment of variations in the macro cast structure and applicability to the ultrasonic flaw detection with respect to the plastic processing. The test piece 1 was subsequently subjected to tensile test, with grip portions 2 and 3 thereof gripped by a suitable tester (not shown). As a result of the tensile test, it was found that a broad width portion W thereof had a small elongation, while a narrow width portion t thereof showed a large elongation. The test piece 1 thus subjected to the tensile test was heated up to 1,100° C., with subsequent quenching, and thereafter machined at opposite surfaces thereof for smoothness, which opposite surfaces were then examined for the macro structure.

FIG. 7 is a photograph showing the macro structure of the above test piece in a state as it was cast, while FIG. 8 shows the macro structure of the same test piece after subjecting it to the tensile test and heat treatment.

As a result of the above described investigation, it was found that the coarse macro structure resulting from casting was converted to a fine macro structure at a portion where the elongation was larger than approximately 6%.

Subsequently, multiple base wave was detected with a 5 MHz vertical probe by an ultrasonic flaw detecting device (not shown) at each part of one surface of the above described test piece 1, for investigating the relation between the elongation and attenuation constant of the ultrasonic wave, the result of which investigation is shown in a graph of FIG. 9, with the attenuation constant as dB/cm taken in the ordinate and elongation in % taken as the abscissa.

As is seen from the above graph, it has been found that the applicability to the ultrasonic flaw detection is not fully improved at elongation in the region of 6%, and that such applicability fully equal to that of the press forged material is obtained at elongation of 10% and over, taking into account the fact that the attenuation constant of SUS304 material is in the region of 0.6 to 1.4 dB/cm. Of course, the relation to the attenuation constant remains unchanged even if the elongation is replaced by the degree of plastic processing in the above graph.

The chemical compositions and the amount of ferrite in the above described test piece are given in TABLE 2 below.

TABLE 2

| C | Si | Mn | Cr | Ni | Ferrite amount |
|---|---|---|---|---|---|
| 0.06 | 1.67 | 1.05 | 19.77 | 8.94 | 14 |

(Remainder is substantially Fe)

Remarks: When the method of the present invention is to be applied to cast steel pipes, it is apparent that, if steel pipes obtained by the centrifugal casting are employed, manufacturing thereof is much facilitated with improved mechanical properties as compared with that of ordinary casting.

As is clear from the foregoing description, stainless steel products produced according to the method of the present invention have intergranular corrosion resistance far higher than the conventional press forged materials of austenite stainless steel, since the material thereof is composed of austenite including 5 to 40% ferrite phase, by which fact, if the stainless steel products of the invention are applied, for example, to welding joints, the intergranular corrosion resistance at portions thereof subjected to thermal influence is remarkably improved as compared with welding joints formed by conventional stainless steel products, with simultaneous increase of strength and stress corrosion resistance. Furthermore, in the method according to the present invention, micro cast structure fully equal to that of press forged material has been achieved in the stainless steel material, making it possible to apply the ultrasonic flaw detection thereto, by using the cast products as base material combined with plastic processing of at least 10% and recrystallizing heat treatment; and the stainless steel product of the invention is free from any surface undulation or roughness even by the plastic processing, thus successfully presenting a smooth surface. Accordingly, even if the stainless steel products used for the important parts, for example, of atomic power generating equipment or various apparatuses related to petrochemical industries as described above have small thicknesses, the ultrasonic flaw detection can advantageously be applied not only to inspections of the parts themselves, but to tests of the welded portions thereof for reliable flaw detection. Moreover, since the problem of the surface roughening during the plastic processing has advantageously been solved, cast pipes of the stainless steel of the invention can, for example, be processed into elbows or bends for practical use.

It should be noted here that the plastic processing of 10% and over applied to the austenite group stainless cast steel product containing 5 to 40% of ferrite phase in the foregoing description may be modified to plastic processing equal to or larger than 10% applied to only a desired portion of the same austenite stainless cast steel product, and that the stainless cast steel products referred to in the foregoing description are not limited to final products, but include semi-finished products for base materials such as those in the form of bars or plates.

It should also be noted that the plastic processing may be effected either through cold working or through hot processing, and that it is possible to effect the hot processing by utilizing the high temperatures of the cast steel products immediately after the casting.

More specifically, regarding the recrystallizing heat treatment wherein the cast steel products subjected to the plastic processing in the above described manner are subsequently kept at recrystallizing temperature for the progress of recrystallization to make the cast structure fine, it is to be noted that in the austenite group stainless steel which inherently requires the solution heat treatment, heating the stainless steel up to the solution heat treatment temperature (1,000°-1,250° C.) and maintaining the same at such temperatures causes the recrystallization to proceed simultaneously, and that by quenching the stainless steel product after the recrystallization, both recrystallizing and solution heat treatments can be completed simultaneously.

Given hereinbelow are further EMBODIMENT and EXAMPLES for illustrating the method of the present invention wherein plastic processing at processing degree equal to or larger than 10% is applied to at least a predetermined portion of a base material of cast steel product of austenite stainless steel containing ferrite phase at casting, with subsequent application of recrystallizing treatment to said cast steel product for making its cast structure fine and for imparting thereto superior intergranular corrosion resistance and satisfactory applicability to the ultrasonic flaw detection.

EXAMPLE 3

Four kinds of test specimens T.P.No. (test piece number) 1 to 4 as shown in TABLE 3 below were cast for studying the relation between the amount of ferrite and the intergranular corrosion resistance of stainless cast steel material of Cr-Ni group. The test specimens were each subjected to cold working at processing degree of 20%, with subsequent recrystallization by being subjected to solution heat treatment at 1,100° C., and water cooling thereafter to form the test specimens into corresponding number of test pieces. Chemical compositions and amount of ferrite are given in TABLE 3 below.

For the intergranular corrosion resistance test, each of the test pieces was first subjected to sensitizing treatment at 700° C. for 2 hours, with subsequent boiling thereof for 16 hours in $H_2SO_4$-$CuSO_4$ solution.

Thereafter, the test pieces were subjected to bending through 180° for examining development of cracks due to the intergranular corrosion, the results of which examination are given in TABLE 4.

For the above tests, a test piece of press forged material SUS304 was also included for comparison, whose chemical compositions and ferrite amount are shown in TABLE 3, with test results thereof shown in TABLE 4.

TABLE 3

| Chemical compositions and amount of ferrite (%) | | | | | | | |
|---|---|---|---|---|---|---|---|
| T.P.No. | | Ferrite amount | C | Si | Mn | Cr | Ni |
| Comparative material | SUS304 | 0 | 0.07 | 0.65 | 1.85 | 17.5 | 9.2 |
| | 1 | 2 | 0.07 | 1.25 | 1.02 | 18.9 | 10.8 |
| Material of present invention | 2 | 5 | 0.07 | 1.23 | 1.00 | 19.2 | 9.5 |
| | 3 | 12 | 0.07 | 1.25 | 1.15 | 20.4 | 8.9 |
| | 4 | 20 | 0.07 | 1.65 | 1.08 | 20.8 | 8.2 |

(Remainder of compositions is substantially Fe)

TABLE 4

| Results of intergranular corrosion resistance test | | |
|---|---|---|
| T.P.No. | | Results after bending the test piece through 180° |
| Comparative material | SUS304 | Cracks developed due to intergranular corrosion |
| | 1 | Same as above |
| Material of present invention | 2 | No trace of intergranular corrosion |
| | 3 | Same as above |
| | 4 | Same as above |

EMBODIMENT 1

A centrifugal cast pipe of external diameter 123 mm, internal diameter 84 mm and length 2,500 mm having a chemical composition and ferrite amount as shown in TABLE 5 was cast as base material, from which cast pipe, a test pipe of 2,000 mm in length was prepared. The test pipe was subjected to the plastic processing at the degree of 20%, with subsequent recrystallization at 1,100° C., and then cooled by water.

TABLE 5

| Chemical compositions and amount of ferrite (%) of base material | | | | | |
|---|---|---|---|---|---|
| C | Si | Mn | Cr | Ni | Ferrite amount |
| 0.06 | 1.24 | 0.54 | 20.48 | 8.56 | 15 |

Referring to photographs of FIGS. 10(*a*) and 10(*b*) showing macro structures of the centrifugal cast pipe as the base material and the test pipe, it is clearly noticed that the centrifugal cast pipe as it is has a coarse cast structure, while the test pipe subjected to the plastic deformation and recrystallizing treatment is imparted with a fine cast structure. Each of the test pipes and the centrifugal cast pipe was formed with a drill hole 2.4 mm in diameter directed from a central portion of thickness of its radial cross section in a tangential direction parallel to the end surface of the pipe, and then subjected to a skew angle flaw detection made in the axial direction from outside of the pipe by a pulse type ultrasonic flaw detecting device (not shown). As a result of the above test, in the centrifugal cast pipe having a coarse cast structure, reflected waves from the drill hole were made equal to various other echos, thus making it impossible to effect the ultrasonic flaw detection, while the pipe having the fine cast structure was not influenced by such echos, with the echo of the drill hole being sufficiently detected, thus giving fully satisfactory applicability to the ultrasonic flaw detection.

Additionally, test pieces taken from the pipe of the above EMBODIMENT 1 and the comparative material SUS304 were subjected to the sensitizing treatment at 700° C. for 2 hours, and then to the intergranular corrosion resistance test in $H_2SO_4$-$CuSO_4$ solution. As a result of the above test, development of cracks due to the intergranular corrosion was noticed in the SUS304 comparative material, while the test piece of the EMBODIMENT 1 showed no trace of such cracks.

Hereinbelow, a further EMBODIMENT illustrating the method of the present invention is given, which is characterized in that the base material of the austenite group stainless cast steel product made to contain ferrite phase in an amount of 5 to 40% at casting is subjected, at least at a predetermined portion, to the plastic processing at a degree equal to or larger than 10%, with subsequent recrystallizing treatment for making its cast structure fine. More specifically, in the casting process of this cast steel product, while the base material of the cast steel is still maintained at high temperatures owing to heat at the casting, for example, at red hot state of 900 to 1,250° C. after solidification of molten metal therefor, the plastic processing at the processing degree equal to or larger than 10% is applied at least to the predetermined portion of the cast steel base material.

EMBODIMENT 2

A centrifugal cast pipe of external diameter 123 mm, internal diameter 84 mm and length 2,500 mm containing the chemical composition and ferrite as shown in TABLE 6 below was cast, and at the red hot state (approximately 1,000° C.) thereof after solidification of molten metal therefor, the pipe was subjected to the plastic processing (compression processing) at the degree of 30%, and then to the recrystallizing treatment at 1,100° C., with subsequent cooling by water.

TABLE 6

| Chemical compositions and amount of ferrite (%) of the material | | | | | |
|---|---|---|---|---|---|
| C | Si | Mn | Cr | Ni | Ferrite amount |
| 0.07 | 1.15 | 0.72 | 20.55 | 8.41 | 16 |

(Remainder of the composition is substantially Fe)

Referring to photographs of FIGS. 11(*a*) and 11(*b*) showing the macro cast structures of the centrifugal cast pipe as base material and the test pipe, it is clearly seen that the centrifugal cast pipe of the base material as it is in FIG. 11(*a*) has a coarse cast structure, while the test pipe in FIG. 11(*b*) subjected to the recrystallizing treatment after the compression plastic deformation as described above is imparted with a fine cast structure.

As a result of the skew angle flaw detection carried out by the pulse type ultrasonic flaw detecting device on the above described two kinds of pipes in the same manner as in EMBODIMENT 1, it was found that the centrifugal cast pipe having the coarse cast structure was unable to be tested for the ultrasonic flaw detection, since reflected waves from the drill hole (EMBODIMENT 1) were made equal to various other echos, while the pipe having the fine cast structure was not influenced by such echos and the echo of the drill hole was successfully detected to give satisfactory applicability to the ultrasonic flaw detection.

Additionally, in the intergranular corrosion resistance test made in $H_2SO_4$-$CuSO_4$ solution, the comparative material SUS304 had cracks developed due to the intergranular corrosion, while the material of the present invention was free from traces of such cracks.

As is clear from the foregoing description, according to the method of the present invention, by the employment of the austenite group stainless steel containing 5 to 40% of ferrite at casting, plastic processing to an extent of 10% and over during hot processing utilizing the heat in casting, and the recrystallizing treatment that follows, results in stainless steel products of high quality superior in the intergranular corrosion resistance and simultaneously provided with excellent applicability to the ultrasonic flaw detection, without requiring any particular procedures such as the strict limitation of the carbon amount or addition of special elements and the like which are necessitated in the conventional methods. Particularly, the intergranular corrosion resistance is found to be higher than that of the conventional stainless cast steel products of single austenite phase by the inclusion of the ferrite phase of 5% and over.

Furthermore, since the plastic processing is effected at the state of high temperatures of the base material owing to heat during casting, not only the processing is facilitated, but extra expenses for heating, labour, etc. are not required. Moreover, the small degree of plastic processing required advantageously compensates for some difficulty in the plastic processing due to simultaneous presence of ferrite and austenite, and makes it possible to partially impart applicability of the ultrasonic flaw detection to the steel products. Thus, the stainless steel products according to the method of the present invention can be widely applied to various important parts, such as pipes and elbows for atomic power plant equipment and petroleum purification, pipings for chemical plants or other parts which are extensively used in the welded state under corrosive conditions, thus being particularly useful for various fields of industry.

Although the present invention has been fully described by way of examples and with reference to the attached drawings and photographs, it is to be noted that various changes and modifications are apparent to those skilled in the art. Therefore, unless such changes and modifications depart from the scope of the present invention, they should be construed as included therein.

What is claimed is:

1. A method of manufacturing a stainless steel product which comprises applying plastic cold processing, at a processing degree selectively equal to or larger than 10%, to at least a predetermined portion of a base material of a centrifugal cast steel product of austenite stainless steel containing, at centrifugal casting, 5 to 40% of a ferrite phase, said cast steel product having a configuration close to that of the final product and a coarse cast structure, subsequently applying a recrystallizing treatment to said cast and cold worked steel product for making the cast structure thereof fine, which recrystallizing treatment comprises heating said cast and cold worked steel product up to the solution heat treatment temperature of 1000 to 1250° C. and maintaining the thus heated product at approximately the same temperature to cause recrystallization thereof, and quenching the thus treated cast steel product after recrystallization.

2. A method of manufacturing a stainless steel product as claimed in claim 1, wherein said plastic cold processing is effected by mechanical deformation of said base material.

* * * * *